US011405711B1

(12) United States Patent
Au et al.

(10) Patent No.: US 11,405,711 B1
(45) Date of Patent: Aug. 2, 2022

(54) HEARING DEVICE HOUSINGS THAT STORE ENERGY AND METHODS OF MAKING THE SAME

(71) Applicant: Sonova AG, Stäfa (CH)

(72) Inventors: Michael Au, Union City, CA (US); Yashvant Venkatakrishnan, San Jose, CA (US); Lu Zhang, San Jose, CA (US)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/378,640

(22) Filed: Jul. 16, 2021

(51) Int. Cl.
*H04R 25/00* (2006.01)
*H04R 1/10* (2006.01)

(52) U.S. Cl.
CPC ..... *H04R 1/1008* (2013.01); *H04R 1/105* (2013.01); *H04R 1/1025* (2013.01)

(58) Field of Classification Search
CPC ..... H04R 25/602; H04R 2225/021; H04R 25/505; H04R 25/554; H04R 25/604; H04R 2225/31; H04R 2225/55
See application file for complete search history.

(56) References Cited

U.S. PATENT DOCUMENTS

| | | | | |
|---|---|---|---|---|
| 8,098,860 | B2 | 1/2012 | Geiger | |
| 8,224,007 | B2 | 7/2012 | Petersen et al. | |
| 2001/0043709 | A1 | 11/2001 | Panitzsch | |
| 2008/0002847 | A1 * | 1/2008 | Geiger | H04R 1/1016 381/323 |
| 2014/0059820 | A1 | 3/2014 | Wright et al. | |

FOREIGN PATENT DOCUMENTS

DE 102015215155 A1 2/2017

OTHER PUBLICATIONS

*Panasonic Develops Bendable, Twistable, Flexible Lithium-ion Battery*, https://news.panasonic.com/global/press/data/2016/09/en160929-8/en160929-8.html (Sep. 29, 2016).

* cited by examiner

*Primary Examiner* — Amir H Etesam
(74) *Attorney, Agent, or Firm* — Henricks Slavin LLP

(57) ABSTRACT

Hearing device housing blanks and methods of making hearing device housings that store energy.

16 Claims, 8 Drawing Sheets

300
304-1
304-2
5
5
302-3
302-2
306
302-1
304-3
302-4
304-4
302-5
326
328
304-5
302-6
304-6
306
302-7
305

302-8
304-7
304-8
4A
4A
305
116
116-1
116-2
302-1
324
306
320
310
312
314
322
308
318
316

300
302-1
302-3
304-1

HEARING DEVICE HOUSINGS THAT STORE ENERGY AND METHODS OF MAKING THE SAME

BACKGROUND

1. Field

The present inventions relate generally to hearing devices with housings that store energy.

2. Description of the Related Art

Some behind-the-ear ("BTE") hearing devices include a BTE component with a microphone and electronics that are located within a housing (sometimes referred to as a "shell") and an in-the-ear ("ITE") component with a receiver and a soft earpiece that centers the receiver relative to the ear canal with the sound output port of the receiver housing facing the tympanic membrane. In other instances, the BTE component includes the receiver and a sound tube is provided. Other hearing devices typically include a housing that is positioned within the ear and/or within the ear canal and a receiver that is located within the housing. In-the-ear hearing devices, in-the-canal hearing devices and completely-in-the-canal hear devices are referred to collectively herein as "ITE hearing devices." The ITE hearing device housings have a sound output port that is positioned facing to the tympanic membrane and connected to the receiver output port. Other hearing device components (e.g., the microphone, electronics and battery) may, for example, be located with the housing or within a faceplate mounted onto the end of the housing opposite the sound port. In both BTE and ITE hearing devices, ambient sound pressure waves are picked up by the microphone and converted into electrical signals. The electrical signals, in turn, are processed by sound processor circuitry. The processed signals drive the receiver, which delivers amplified (or otherwise processed) sound pressure waves to the ear canal.

The present inventors have determined that BTE and ITE hearing devices are susceptible to improvement. For example, power for BTE and ITE hearing devices is typically provided by batteries that are located within the hearing device housing. Such batteries include non-rechargeable cylindrical button cell zinc-air batteries and rechargeable lithium-ion batteries with similar formfactors. The present inventors have determined, among other things, that the use of such batteries places design limitations on BTE hearing devices and inhibits efforts to reduce the size of ITE hearing devices.

SUMMARY

A BTE hearing device housing blank in accordance with at least one of the present inventions includes a plurality of battery regions and a plurality of hinge regions. The battery regions and the hinge regions together define a relatively flat structure and the battery regions and the hinge regions are sized, shaped and arranged relative to one another such that the relatively flat structure will be in the shape of a BTE hearing device housing when the hinge regions are bent to a predetermined non-flat state.

An ITE hearing device housing blank in accordance with at least one of the present inventions includes a base, a plurality of battery regions extending from the base, and a plurality of gaps respectively located between adjacent battery regions. The base and the battery regions together define a relatively flat structure and the battery regions are sized, shaped and arranged relative to one another such that the relatively flat structure will be in the shape of an ITE hearing device housing when the housing blank is wrapped around a mandrel with a shape corresponding to the ITE hearing device housing and the battery regions are pressed against the mandrel.

A method in accordance with at least one of the present inventions deforming a hearing device blank, including at least one battery region, from a relatively flat state to a shape corresponding to a hearing device housing.

There are a variety of advantages associated with such apparatus and methods. By way of example, but not limitation, the present inventions eliminate the design constraints associated with the use of conventional batteries and facilitates size reductions of hearing devices.

The above described and many other features and advantages of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF EXEMPLARY EMBODIMENTS

The following is a detailed description of the best presently known modes of carrying out the inventions. This description is not to be taken in a limiting sense, but is made merely for the purpose of illustrating the general principles of the inventions. It should also be noted that if and when used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

Figure 1:
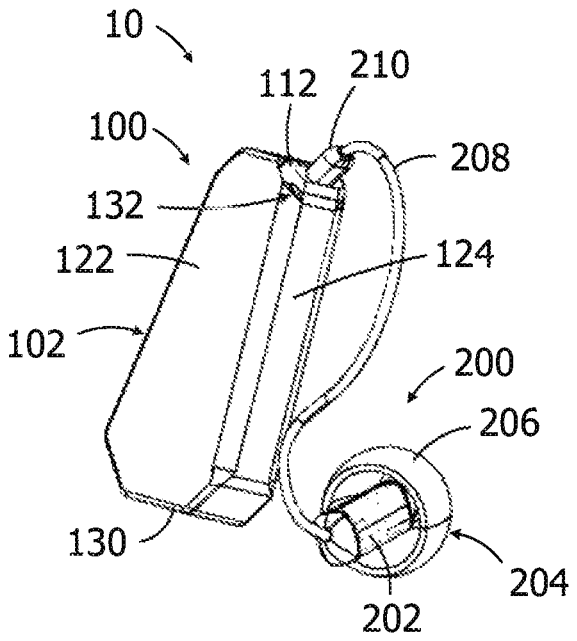
FIG. 1 is a perspective view of a hearing device in accordance with one embodiment of a present invention.
Figure 2:
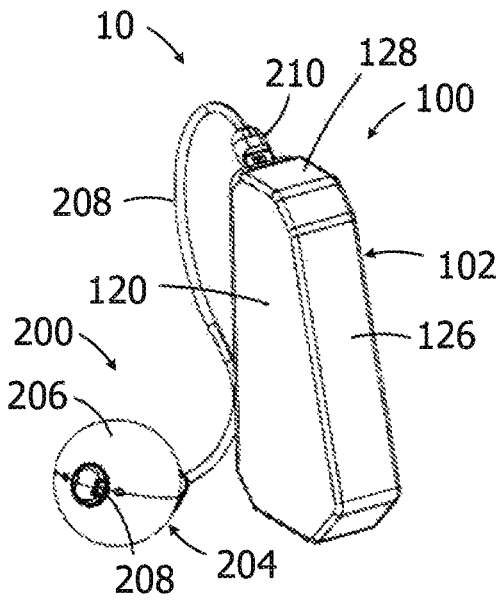
FIG. 2 is a perspective view of the hearing device illustrated in FIG. 1.
Figure 3:
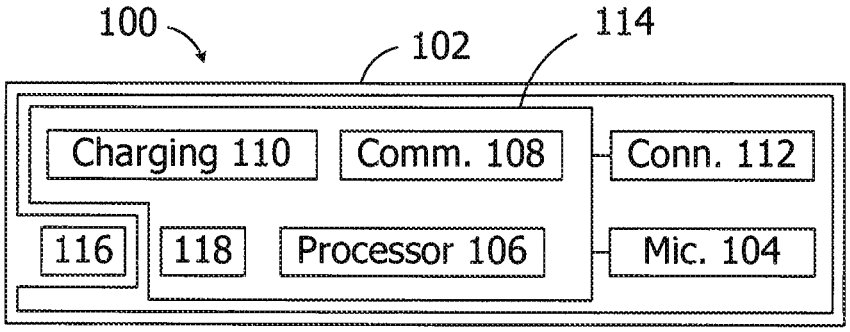
FIG. 3 is a block diagram of the hearing device illustrated in FIG. 1.

As illustrated in FIGS. 1-3, one example of a BTE hearing device, which is generally identified by reference numeral 10, includes a BTE component 100 that receives sound (including sound signals from another device) and an ITE component 200 that delivers sound to ear canal. The exemplary BTE component 100 may have a housing 102, one or more microphones 104, a processor 106 that may be used for sound processing and other processing functions described herein, a wireless communication apparatus 108, a charging apparatus 110, and a connector 112 that is used to connect the BTE component 100 to the ITE component 200. The exemplary housing 102 functions as both an outer shell and as a power storage device, as is discussed in greater detail below, and includes a pair of side walls 120 and 122, a front wall 124, a rear wall 126, a top wall 128, a bottom wall 130 and an opening 132 for the connector 112. The communication apparatus 108, which may be in the form of an antenna and a receiver/transmitter, allows the BTE component to communicate with external devices such as mobile phones and computers. The charging apparatus 110 may be, for example, a wireless charging apparatus that includes an induction coil, or may be a galvanic charging apparatus (not shown) that includes electrical contacts on the exterior of the housing 102. Some or all of the components within the housing 102 may be located on a circuit board 114. The housing 102 is electrically connected to the circuit board 114 by a connector 116 on the housing and a connector 118 on the circuit board. The connectors 116 and 118, which may each consist of a pair of contacts, facilitate the transmission of power stored by the housing 102 to the components within the housing and the recharging of the power storing portion of the housing with the charging apparatus 110. A control panel may be provided on the exterior of the BTE component 100 in some implementations, as is discussed below with reference to FIGS. 15 and 16.

The exemplary ITE component 200 includes a receiver 202 and an earpiece 204 that is mounted on the medial end of the receiver to center the receiver relative to the ear canal. The exemplary receiver 202 includes a miniature loudspeaker that is located within a receiver housing with a sound outlet (not shown). The earpiece 204 includes a dome 206 and sound outlets 208. The earpiece 204 may be formed from elastomeric material having compliance properties (and dimensions) configured to conform to the shape of the intended portion of the ear canal and exert a spring force on the ear canal so as to hold the receiver assembly 202 in place in the ear canal. A multi-wire cable 208, which has a connector 210 that is configured to mate with the connector 112, electrically connects the BTE component 100 to the ITE component 200.

The exemplary BTE housing 102, as well as other housings in accordance with the present inventions, may be formed from a housing blank that may be bent, folded or otherwise deformed from an initial flat state to a state corresponding to the shape of the housing. The shape of BTE hearing device housing is a shape that is narrower, in the anterior-poster direction, in the superior end region than it is in the inferior end region and, when placed behind a human ear, some, most or all of the lateral surface of the housing surface will be covered by portions of the outer ear such as the helix, scapha and/or triangular fossa. The anterior and posterior surfaces may be planar (as shown) or curved. One example of a housing blank that may be used to form the housing 102 is generally represented by reference numeral 300 in FIGS. 4 and 5. The exemplary housing blank 300 includes a plurality of battery regions 302-1 to 302-8 (collectively "battery regions 302"), a plurality of battery regions 304-1 to 304-8 (collectively "battery regions 304") that are located between battery regions 302, a tab 305 for the connector 116, and a perimeter region 306 that extends around the entire housing blank. The exemplary connector consists of a pair of contacts 116-1 and 116-2.

The battery regions 302 in the illustrated embodiment are relatively thick, as compared to the battery regions 304, and the battery regions 304 are relatively thin, as compared to the battery regions 302. The relatively thin battery regions 304 also function as hinge regions where the housing blank 300 is bent in predetermined manners that result in the housing blank assuming the shape of the housing 102. The exemplary housing blank 300 may also be a relatively flat structure where the battery regions 302 and 304 are planar and parallel to one another.

Figures 4, 4A, 5:
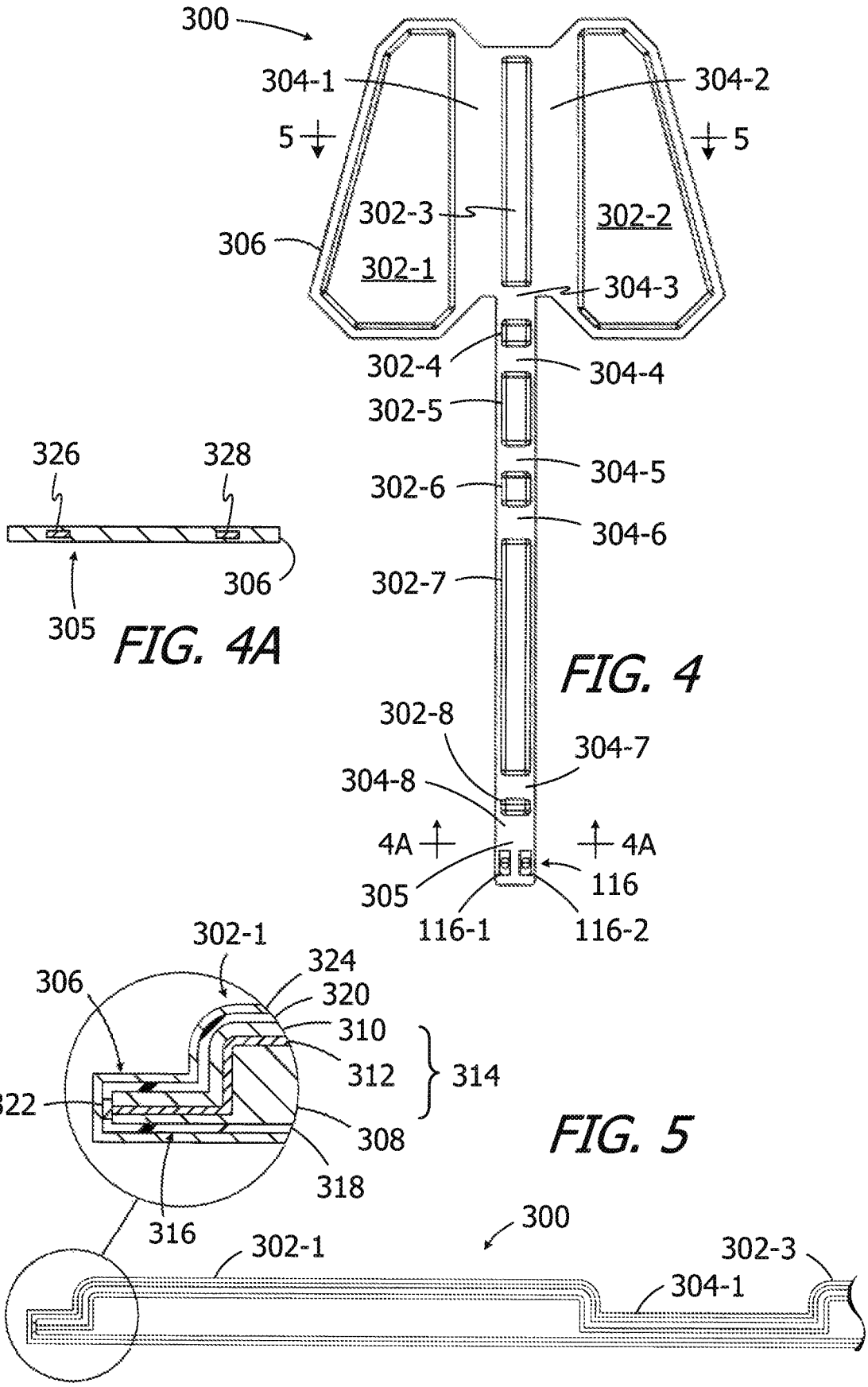
FIG. 4 is a plan view of a hearing device housing blank in accordance with one embodiment of a present invention.
FIG. 4A is a section view taken along line 4A-4A in FIG. 4.
FIG. 5 is a section view taken along line 5-5 in FIG. 4.

Referring more specifically to FIG. 5, the exemplary housing blank 300 includes an anode layer 308, a cathode layer 310 and a separator layer 312 that together define a battery 314. The battery 314 is located within a pouch 316 that includes foil layers 318 and 320 and a seal 322. The battery 314 and pouch 316 are located within electrically non-conductive outer casing 324. In the illustrated implementation, the contacts 116-1 and 116-2 are part of narrow extensions 326 and 328 (FIG. 4A) of the anode layer 308 and the cathode layer 310 that extend from the battery region 304-8 and into the tab 305. The ends of the extensions 326 and 328 are exposed by way of openings in the tab 305 to form the contacts 116-1 and 116-2.

The battery regions 302 and 304 in the illustrated embodiment together form a single, continuous battery cell, i.e., battery 314, with one anode layer, one cathode layer and one separator layer. In other embodiments, a multicell battery, with the cells connected in series or parallel, may be employed.

Suitable materials for the anode layer 308 include, but are not limited to, Carbon (Graphite) with electrolyte. Suitable materials for the cathode layer 310 include, but are not limited to, Lithium metal oxide with electrolyte. Suitable materials for the separator layer 312 include, but are not limited to, polymer. Suitable materials for the foil layers 318 and 320 include, but are not limited to, aluminum or copper. Suitable materials for the outer casing 324 include, but are not limited to, polymer. In the illustrated implementation, the respective thicknesses of the cathode layer 310, separator layer 312, foil layers 318 and 320, and outer casing 324 are constant, while the thickness of the anode layer 308 is thicker in the battery regions 302 than it is in the battery regions 304. The tab 305 may be formed from the same electrically non-conductive material as the outer casing 324 or any other suitable material.

Figure 6:
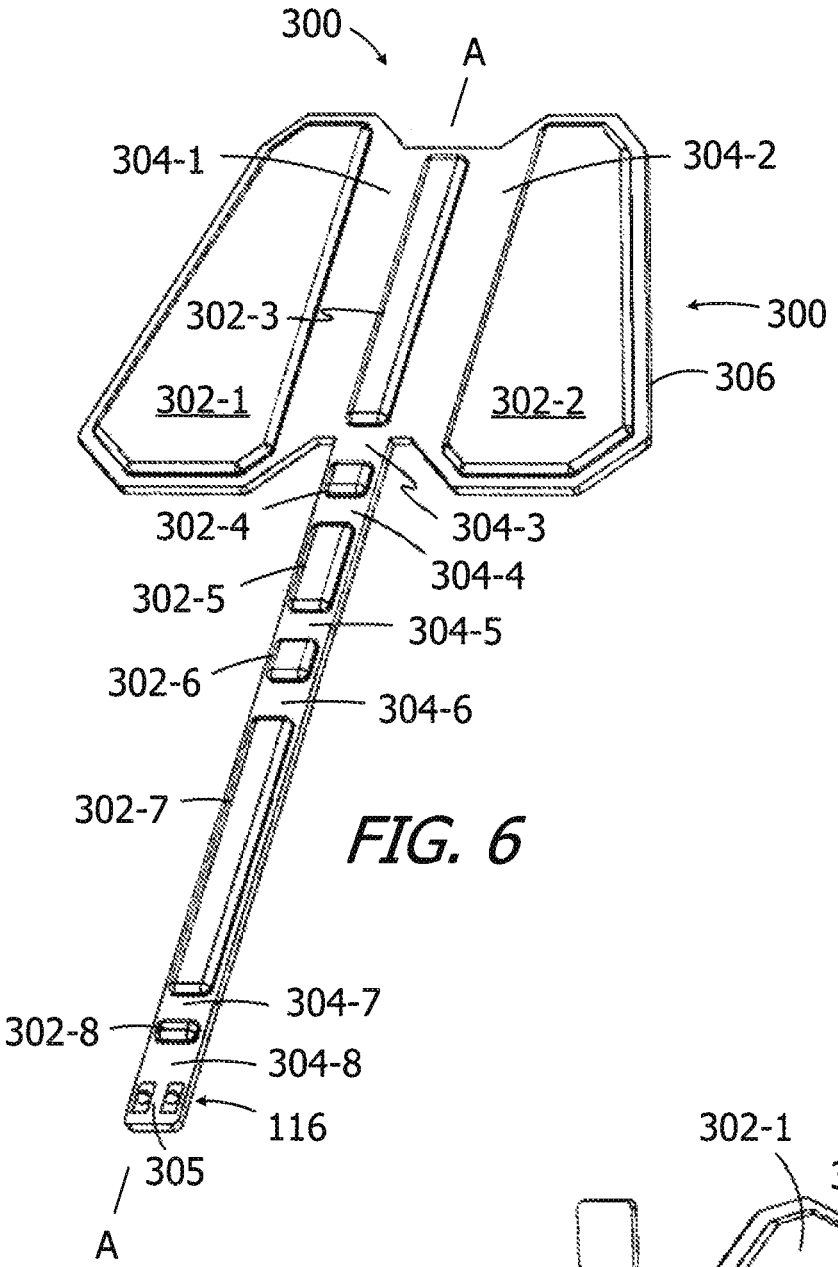
FIG. 6 is a perspective view showing a portion of a method in accordance with one embodiment of a present invention.
Figure 7:
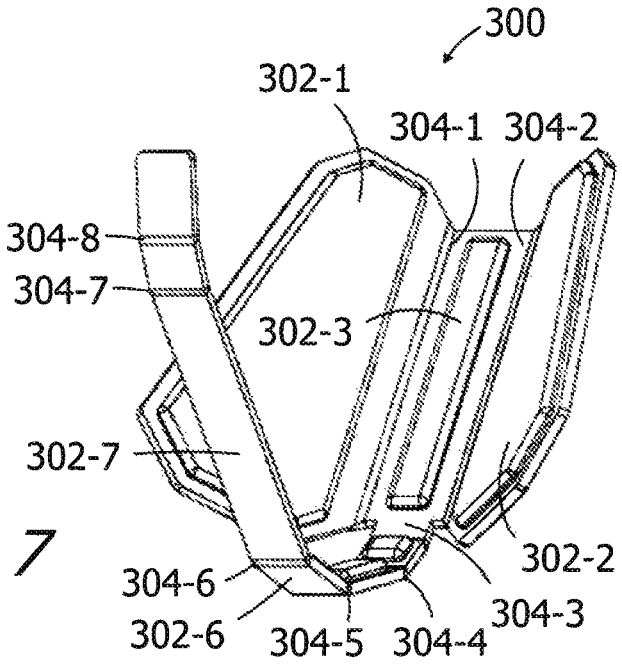
FIG. 7 is a perspective view showing a portion of a method in accordance with one embodiment of a present invention.
Figure 8:
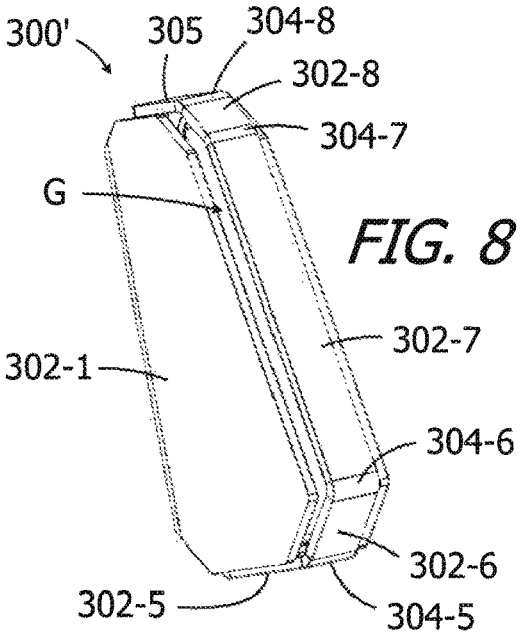
FIG. 8 is a perspective view showing a portion of a method in accordance with one embodiment of a present invention.
Figure 9:
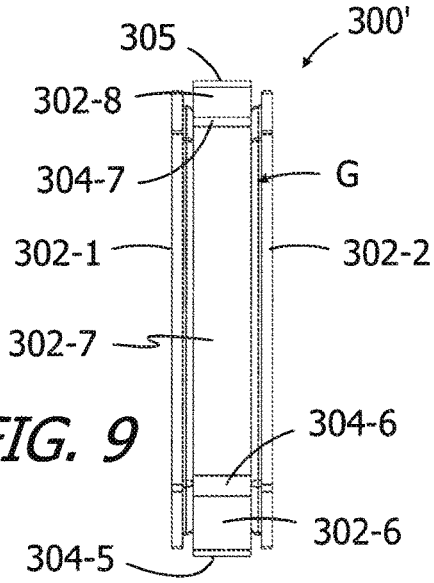
FIG. 9 is an end view showing a portion of a method in accordance with one embodiment of a present invention.
Figure 10:
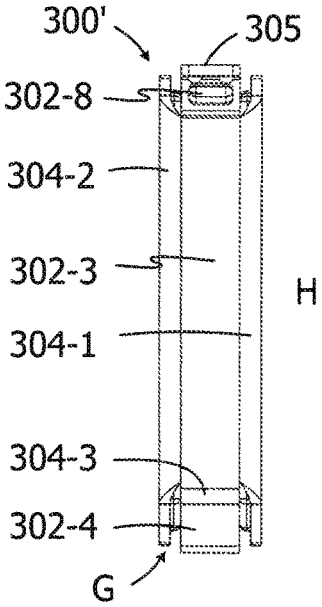
FIG. 10 is an end view showing a portion of a method in accordance with one embodiment of a present invention.
Figure 11:
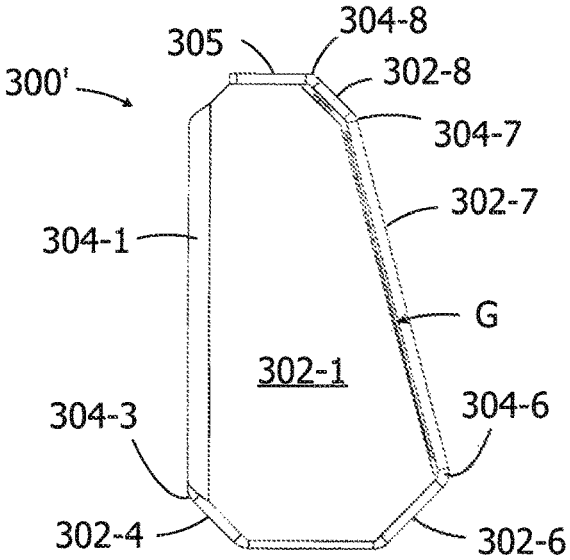
FIG. 11 is a side view showing a portion of a method in accordance with one embodiment of a present invention.
Figure 12:
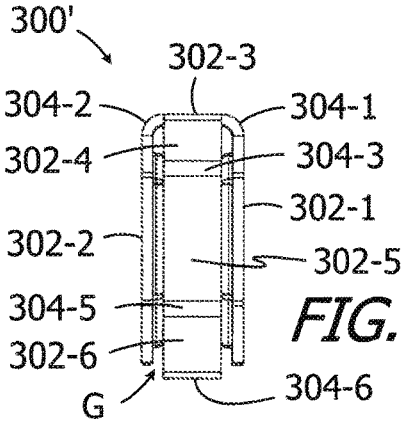
FIG. 12 is a bottom view showing a portion of a method in accordance with one embodiment of a present invention.
Figure 13:
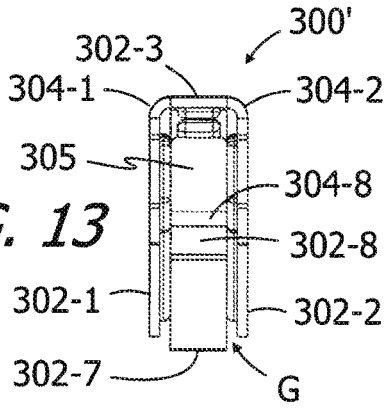
FIG. 13 is a top view showing a portion of a method in accordance with one embodiment of a present invention.

In one exemplary method, the exemplary housing blank 300 may be deformed from the initial flat state illustrated in FIG. 6 to the fully bent state illustrated in FIGS. 8-13 by bending the housing blank at the manner exemplified by FIG. 7. Referring more specifically to FIG. 7, the relatively thick battery regions 302-1 and 302-2 may be pivoted relative to the relatively thick battery region 302-3 by bending the housing blank 300 within the relatively thin battery regions 304-1 and 304-2. The bends within the relatively thin battery regions 304-1 and 304-2 may be parallel to the longitudinal axis A. The relatively thick battery regions 302-4 to 302-8, as well as the tab 305, may be pivoted relative to one another by bending the housing blank 300 within the relatively thin battery regions 304-3 and 304-8. The bends within the relatively thin battery regions 304-3 and 304-8 may be perpendicular to the longitudinal axis A. The relatively thick battery regions 302-1 to 302-8 and tab 305 may be pivoted individually, or may be pivoted in one or more groups.

The bending may continue until the relatively thick battery regions 302-1 to 302-8 and the tab 305 reach the positions illustrated in FIGS. 8-13, where the bent housing blank (represented by reference numeral 300') assumes the overall shape of the housing 102. Referring also to FIGS. 1 and 2, the relatively thick battery regions 302-1 and 302-2 of the bent housing blank 300' (and adjacent portions of the perimeter region 306) will form the side walls 120 and 122 of the housing 102, while the relatively thick battery region 302-3 will form the front wall 124 of the housing, and the relatively thin battery regions 304-1 and 304-2 form the corners between the side walls 120 and 122 and front wall 124. The relatively thick battery regions 302-4 to 302-6 (and adjacent portions of the perimeter region 306) together form the multi-part bottom wall 130, the relatively thick battery region 302-7 (and adjacent portions of the perimeter region 306) forms the rear wall 126, and the relatively thick battery region 302-8 and the tab 305 (and adjacent portions of the perimeter region 306) together form the multi-part top wall 128.

The microphone 104, the connector 112, and the circuit board 114 (including the components carried thereon) may be combined with the housing blank 300 before, during or after the bending process, and the connectors 116 and 118 may be brought into contact with one another at that time. For example, the housing blank 300 may be bent around the microphone 104, the connector 112, the circuit board 114. Alternatively, the microphone 104, the connector 112, the circuit board 114 may be inserted into the partially bent blank during an intermediate portion of the bending process, or when a portion of a completely bent housing blank 300' is bent out of its final state to accommodate insertion of the various components.

Figure 14:
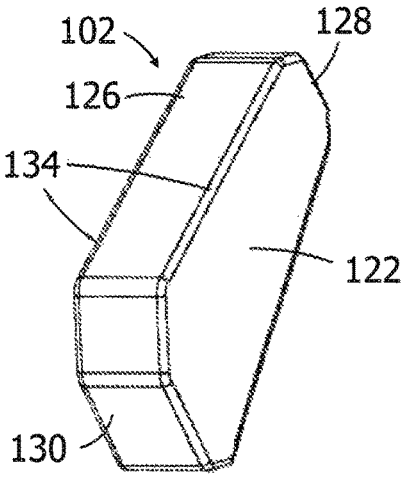
FIG. 14 is a perspective view showing a portion of a method in accordance with one embodiment of a present invention.

In the exemplary configuration, gaps G between various portions of the bent housing blank 300' may remain (FIGS. 8-13). The gaps G may be filled with a bonding material 134 (e.g., an epoxy) or other suitable substance, as is shown in FIG. 14, to complete the housing 102. In other implementations, the configuration of the housing blank may result in a gapless final state. In either case, the entire outer (and/or inner) surface of the housing 102 may be coated with a layer of bonding material (e.g., epoxy) to increase mechanical stability of the housing, improve the protection for the electronics within the housing, and provide a desired appearance. Coloring, lacquering and polishing techniques may also be employed to improve appearance.

Figure 15:
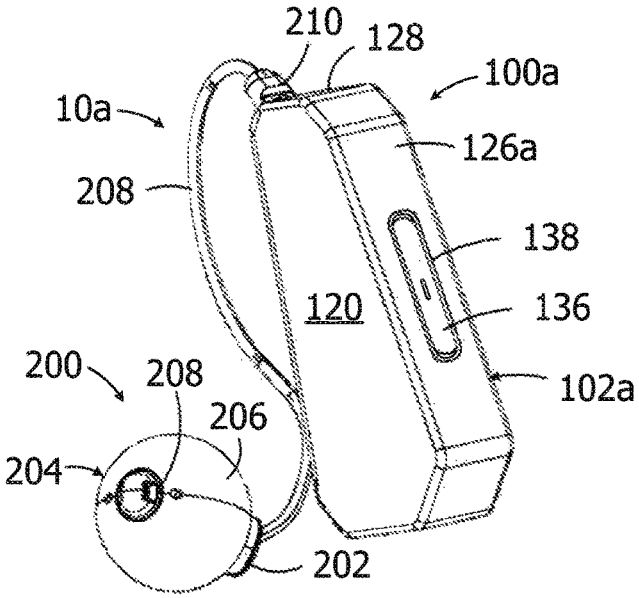
FIG. 15 is a perspective view of a hearing device in accordance with one embodiment of a present invention.

Another exemplary BTE hearing device, which is generally identified by reference numeral 10*a* in FIG. 15, is substantially similar to BTE hearing device 10 and similar elements are represented by similar reference numerals. For example the BTE hearing device 10*a* includes a BTE component 100*a* and an ITE component 200. Here, however, the BTE component 100*a* includes a switch 136 (e.g., an on-off and/or volume control switch) that extends through an opening 138 in the housing 102*a*.

Figure 16:
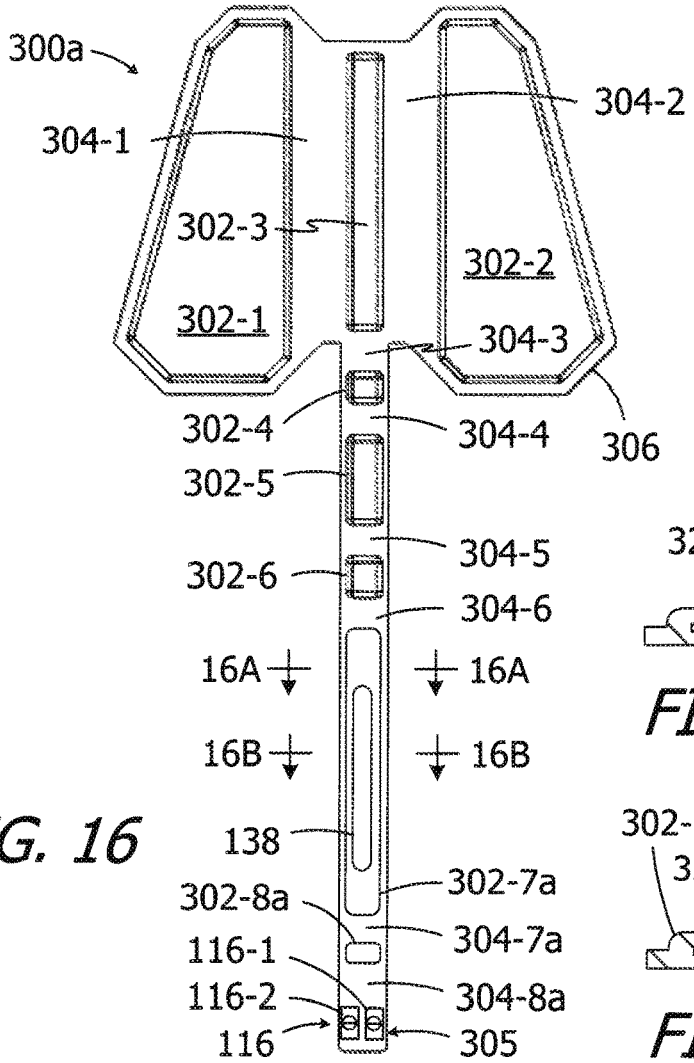
FIG. 16 is a plan view of a hearing device housing blank in accordance with one embodiment of a present invention.
Figure 16A:
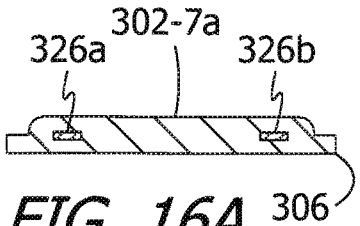
FIG. 16A is a section view taken along line 16A-16A in FIG. 16.
Figure 16B:
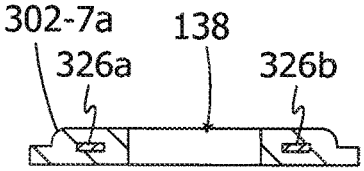
FIG. 16B is a section view taken along line 16B-16B in FIG. 16.

One example of a housing blank that may be used to form the housing 102*a* illustrated in FIG. 15 is the housing blank 300*a* illustrated in FIGS. 16-16B. Housing blank 300*a* is substantially similar to housing blank 300 and similar elements are represented by similar reference numerals. For example, the housing blank 300 includes a plurality of relatively thick battery regions 302-1 to 302-6, a plurality of relatively thin battery regions 304-1 to 304-6, a tab 305*a* for the connector 116, and a perimeter region 306 that extends around the entire housing blank. Housing blank 300*a* may also be bent, folded or otherwise deformed from a flat state to a shape corresponding to housing 102*a* in the manner described above with reference to FIGS. 6-14. Here, however, the energy storage portion of the housing blank 300*a* ends at the relatively thin battery region 304-6 to accommodate the opening 138, and the housing blank 300*a* is provided with relatively thick non-battery regions 302-7*a* and 302-8*a* (in place of relatively thick battery regions 302-7 and 302-8) and relatively thin non-battery regions 304-7*a* and 304-8*a* (in place of relatively thin battery regions 304-7 and 304-8). In the illustrated implementation, the non-battery regions 302-7*a*, 302-8*a*, 304-7*a* and 304-8*a* are formed from the same electrically non-conductive material as the outer casing 324 or any other suitable material.

The contacts 116-1 and 116-2 may be part of narrow extensions 326*a* and 328*a* of the anode layer 308 and the cathode layer 310 that extend from the battery region 304-6, through the non-battery regions 302-7*a*, 302-8*a*, 304-7*a* and 304-8*a* (FIGS. 16A and 16B), and into the tab 305*a*. The ends of the extensions 326*a* and 328*a* are exposed by way of openings in the tab 305*a* to form the contacts 116-1 and 116-2.

Figure 17:
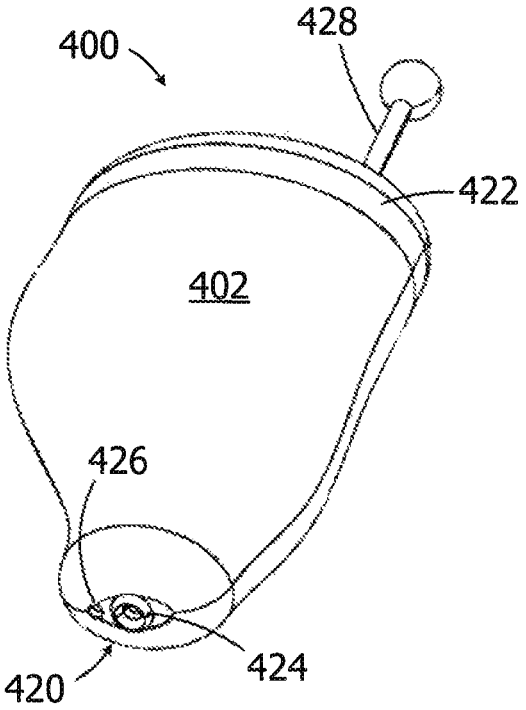
FIG. 17 is a perspective view of a hearing device in accordance with one embodiment of a present invention.
Figure 18:
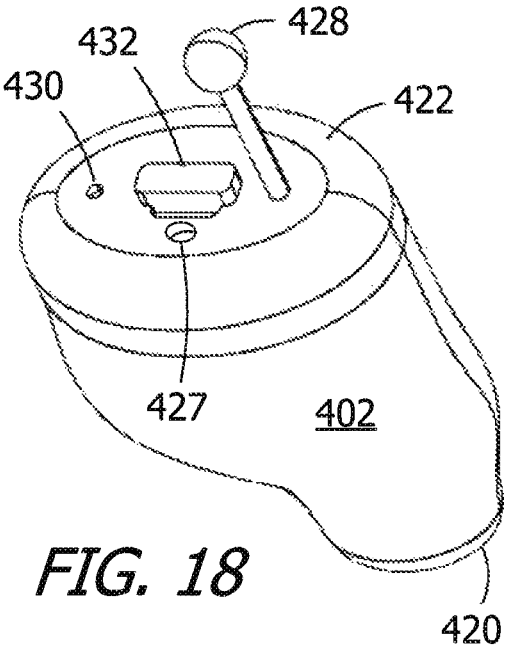
FIG. 18 is a perspective view of the hearing device illustrated in FIG. 17.
Figure 19:
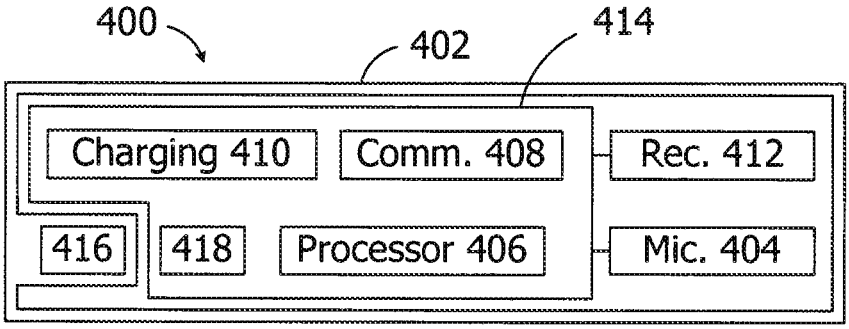
FIG. 19 is a block diagram of the hearing device illustrated in FIG. 17.

One example of an ITE hearing device is generally represented by reference numeral 400 in FIGS. 17-19. The exemplary ITE hearing device 400 may include a housing 402, a microphone 404, a processor 406 that may be used for sound processing and other processing functions described herein, a wireless communication apparatus 408, a charging apparatus 410, and a receiver 412. The housing 402, which functions as both an outer shell and as a power storage device, as is discussed in greater detail above and below, may be generic sizes and shapes that are suitable for (or "correspond to") the ear and/or ear canal of a large number of patients or may be a custom shape that is intended for (or "corresponds to") the ear and/or ear canal of a particular patient. The communication apparatus 108, which may be in the form of an antenna and a receiver/transmitter, allows the ITE hearing device 400 to communicate with external devices such as mobile phones and computers. The charging apparatus 410 may be, for example, a wireless charging apparatus that includes an induction coil or may be a galvanic charging apparatus that includes electrical contacts (not shown) on the exterior of the housing 402. Some or all of the components within the housing 102 may be located on a circuit board 414. The housing 402 is electrically connected to the circuit board 414 by a connector 416 on the housing and a connector 418 on the circuit board. The connectors 416 and 418, which may each consist of a pair of contacts, facilitate the transmission of power stored by the housing 402 to the components within the housing and the recharging of the power storing portion of the housing with the charging apparatus 410.

The exemplary ITE hearing device 400 also includes a medial housing cover 420 and a lateral housing cover 422 that are secured to the medial and lateral ends of the housing 402. The exemplary medial housing cover 420 includes a sound port 424 and a venting aperture 426, while the lateral housing cover 422 includes a sound port 427, a removal handle 428, a venting aperture 430 and a push button 432 that may perform various functions.

Figure 20:
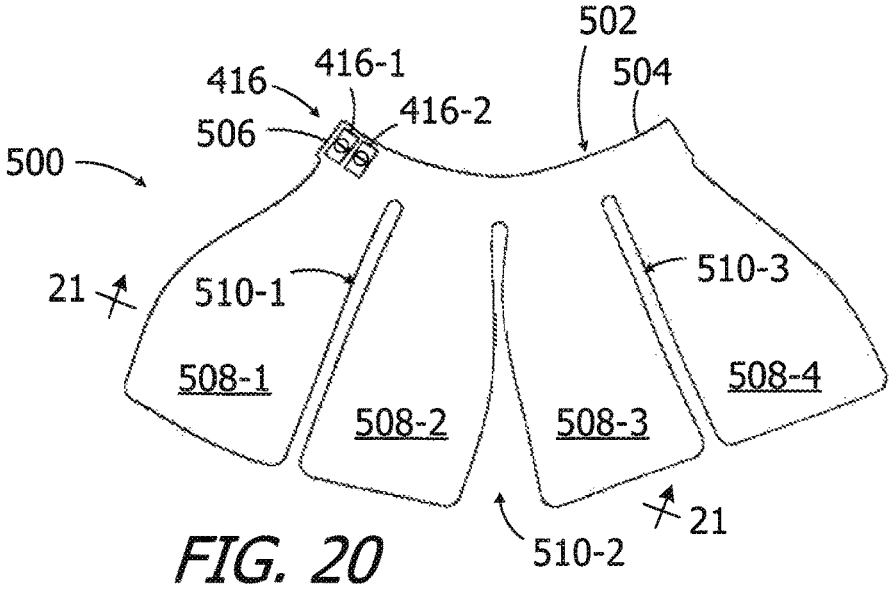
FIG. 20 is a plan view of a hearing device housing blank in accordance with one embodiment of a present invention.
Figure 21:
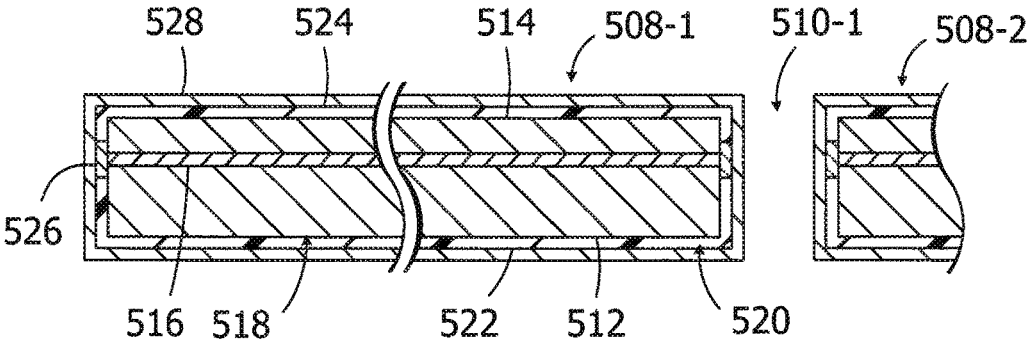
FIG. 21 is a section view taken along line 21-21 in FIG. 20.

The exemplary housing 402 may be formed from an initially flat housing blank that has been wrapped around a mandrel having a shape corresponding to the shape of the housing and then pressed against the mandrel as necessary. Turning to FIGS. 20 and 21, one example of such a housing blank, which is generally represented by reference numeral 500, includes a base 502, with a base battery region 504 and a base connector region 506, a plurality of spaced battery regions 508-1 to 508-4 (collectively "battery regions 508") that extend from the base. A plurality of open spaces (or "gaps") 510-1 to 510-3 (collectively "510") are located between adjacent spaced battery regions 508. The gaps 510 allow the housing blank 500 to be wrapped around and formed against mandrels, including differently sized mandrels, without the creation of creases and stressed regions. The connector 416, which consists of a pair of contacts 416-1 and 416-2, is located on the base connector region 506. The overall size and shape (including the shapes of the battery regions) of exemplary housing blank 500, which is a relatively flat structure where the base 502 and battery regions 508 are planar and parallel to one another, may correspond to generic sized and shaped housings that are suitable for a large number of patients or may correspond to a custom sized and shaped housing intended for the ear canal of a particular patient. With the respect to the custom size and shape, the particulars of the intended patient's ear canal may be obtained using an ear impression and a three-dimensional scan thereof.

Referring more specifically to FIG. 21, the exemplary housing blank 500 includes an anode layer 512, a cathode layer 514 and a separator layer 516 that together define a battery 518. The battery 518 is located within a pouch 520 that includes foil layers 522 and 524 and a seal 526. The battery 518 and pouch 520 are located within electrically non-conductive outer casing 528. Suitable materials for the anode layer 512, cathode layer 514, separator layer 516, foil layers 522 and 524, and outer casing 528 are described above with reference to housing blank 300. The base connector region 506 may be formed from the same electrically non-conductive material as the outer casing 528 or any other suitable material. The battery regions 504 and 508 in the illustrated embodiment together form a single, continuous battery cell, i.e., battery 518, with one anode layer, one cathode layer and one separator layer. In other embodiments, a multicell battery, with the cells connected in series or parallel, may be employed.

Figure 22:
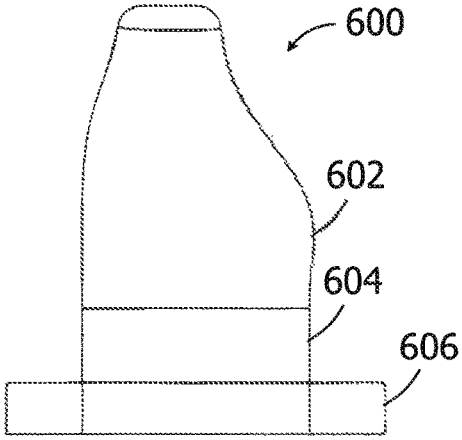
FIG. 22 is a side view of a mandrel in accordance with one embodiment of a present invention.
Figure 23:
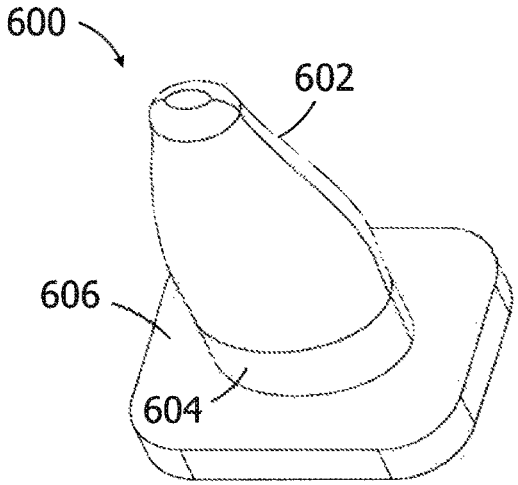
FIG. 23 is a perspective view of the mandrel illustrated in FIG. 22.

One example of a mandrel about which the housing blank 500 may be wrapped to form an ITE hearing device housing, such as housing 402, is generally represented by reference numeral 600 in FIGS. 22 and 23. The exemplary mandrel includes a housing portion 602 which has a shape and size corresponding to the shape and size of the inner surface of the intended ITE hearing device housing (e.g., housing 402) and may also include a pedestal 604 and a base 606. The mandrel 600 may correspond to generic sized and shaped housings that are suitable for a large number of patients or may correspond be a custom sized and shaped housing intended for the ear canal of a particular patient.

Figure 24:
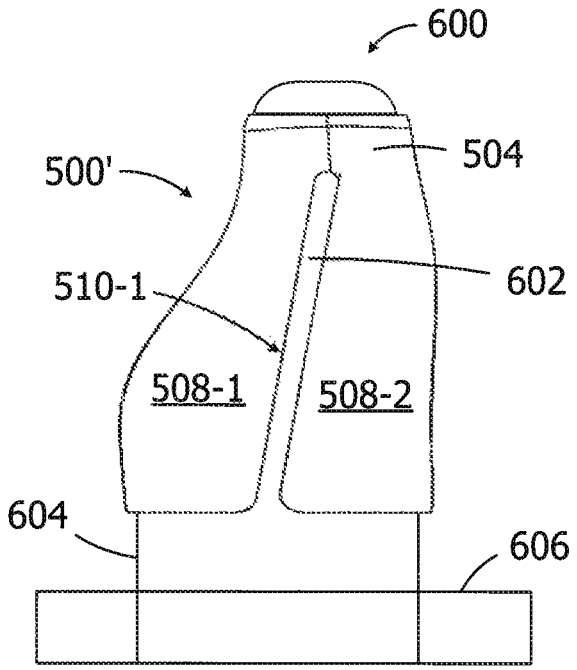
FIG. 24 is a side view showing a portion of a method in accordance with one embodiment of a present invention.
Figure 25:
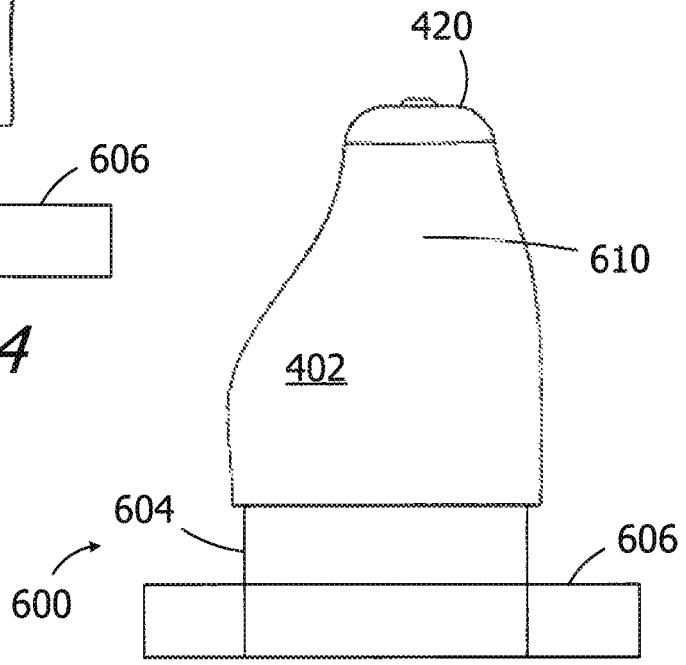
FIG. 25 is a side view showing a portion of a method in accordance with one embodiment of a present invention.
Figure 26:
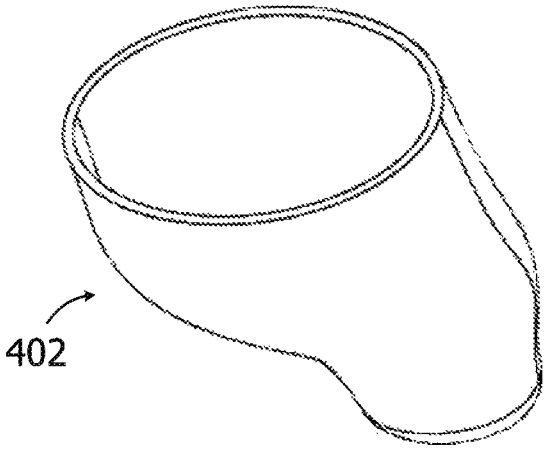
FIG. 26 is a perspective view showing a portion of a method in accordance with one embodiment of a present invention.

Turning to FIGS. 24-26, the housing blank 500 illustrated in FIG. 20 may be deformed from the initial flat state illustrated in FIG. 20 to a state corresponding to the overall shape of the housing 402 (represented by reference numeral 500') by wrapping the housing blank around the mandrel housing portion 602 and pressing the housing blank against the mandrel. In those instances where one or more of the gaps 510 remains, the gap(s) may be filled with a bonding material 610 (e.g., an epoxy) or other suitable substance, as shown in FIG. 25, to complete the housing 402. The medial housing cover 420 may be secured to the housing 402 while the housing is on the mandrel 600, as also shown in FIG. 25, or may be secured to the housing at a later time. In either case, the housing 402 is removed from the mandrel to complete the reconfiguration of the housing blank 500 into the housing 402 (FIG. 26). The entire outer (and/or inner) surface of the housing 402 may be coated with a layer of bonding material (e.g., epoxy) to increase mechanical stability of the housing, improve the protection for the electronics within the housing, and provide a desired appearance. Coloring, lacquering and polishing techniques may also be employed to improve appearance.

Thereafter, the microphone 404, receiver 412 and circuit board 414 (including the components carried thereon) may then be inserted into the housing 402, and the contacts 416 and 418 may be brought into contact with one another. The lateral housing cover 422 may then be secured to the housing 402.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A behind-the-ear (BTE) hearing device housing blank, comprising:

a plurality of battery regions; and a plurality of hinge regions;

wherein the battery regions and the hinge regions together define a relatively flat structure; and wherein the battery regions and the hinge regions are sized, shaped and arranged relative to one another such that the relatively flat structure will be in the shape of a BTE hearing device housing when the hinge regions are bent to a predetermined non-flat state.

2. A BTE hearing device housing blank as claimed in claim 1, wherein the battery regions define first battery regions; and the hinge regions comprise second battery regions that are thinner than the first battery regions.

3. A BTE hearing device housing blank as claimed in claim 2, wherein the first and second battery regions are integral with one another and together define a single battery.

4. A BTE hearing device housing blank as claimed in claim 2, wherein the first battery regions include an anode layer, a cathode layer and a separator layer between the anode layer and the cathode layer;

the second battery regions include an anode layer, a cathode layer and a separator layer between the anode layer and the cathode layer; and the anode layers in the first battery regions are thicker than the anode layers in the second battery regions.

5. A BTE hearing device housing blank as claimed in claim 4, further comprising:

a foil casing that encloses the anode layer, the cathode layer, and the separator layer.

6. A BTE hearing device housing blank as claimed in claim 1, further comprising:

an electrically non-conductive outer casing that encloses the battery regions and the hinge regions.

7. A BTE hearing device housing blank as claimed in claim 6, wherein the electrically non-conductive outer casing comprises a plastic outer casing.

8. A BTE hearing device housing blank as claimed in claim 1, wherein the BTE hearing device housing shape defines a superior end region and an inferior end region and is narrower, in the anterior-poster direction, in the superior end region than it is in the inferior end region.

9. An in-the-ear (ITE) hearing device housing blank, comprising:

a base;

a plurality of battery regions extending from the base; and a plurality of gaps respectively located between adjacent battery regions;

wherein the base and the battery regions together define a relatively flat structure; and wherein the battery regions are sized, shaped and arranged relative to one another such that the relatively flat structure will be in the shape of an ITE hearing device housing when the housing blank is wrapped around a mandrel with a shape corresponding to the ITE hearing device housing and the battery regions are pressed against the mandrel.

10. An ITE hearing device housing blank as claimed in claim 9, wherein the base includes a base battery region.

11. An ITE hearing device housing blank as claimed in claim 10, wherein the battery regions that extend from the base are integral with the base battery region and together define a single battery.

12. An ITE hearing device housing blank as claimed in claim 9, wherein the battery regions include an anode layer, a cathode layer and a separator layer between the anode layer and the cathode layer.

13. An ITE hearing device housing blank as claimed in claim 12, further comprising:

a foil casing that encloses the anode layer, the cathode layer, and the separator layer.

14. An ITE hearing device housing blank as claimed in claim 9, further comprising:

an electrically non-conductive outer casing that encloses the battery regions and the base.

15. An ITE hearing device housing blank as claimed in claim 14, wherein the electrically non-conductive outer casing comprises a plastic outer casing.

16. An ITE hearing device housing blank as claimed in claim 9, wherein the BTE hearing device housing shape corresponds to a human ear and/or a human ear canal.

* * * * *